US010896644B2

(12) United States Patent
Do et al.

(10) Patent No.: US 10,896,644 B2
(45) Date of Patent: Jan. 19, 2021

(54) ORGANIC LIGHT EMITTING DISPLAY DEVICE AND PIXEL SENSING METHOD OF THE SAME

(71) Applicant: LG Display Co., Ltd., Seoul (KR)

(72) Inventors: Osung Do, Paju-si (KR); Changwoo Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/701,151

(22) Filed: Dec. 2, 2019

(65) Prior Publication Data

US 2020/0202787 A1 Jun. 25, 2020

(30) Foreign Application Priority Data

Dec. 20, 2018 (KR) ..... 10-2018-0166699

(51) Int. Cl.
*G09G 3/3258* (2016.01)
*G09G 3/20* (2006.01)

(52) U.S. Cl.
CPC ..... *G09G 3/3258* (2013.01); *G09G 3/2007* (2013.01); *G09G 2310/0291* (2013.01); *G09G 2310/0294* (2013.01); *G09G 2310/08* (2013.01); *G09G 2320/0233* (2013.01)

(58) Field of Classification Search
CPC ..... G09G 3/3258
See application file for complete search history.

(56) References Cited

U.S. PATENT DOCUMENTS

2015/0379909 A1 12/2015 Yu et al.
2017/0365205 A1 12/2017 Kishi et al.
2018/0033366 A1 2/2018 Yoo et al.

OTHER PUBLICATIONS

The Intellectual Property Office of the United Kingdom, Combined Search and Examination Report, GB Patent Application No. 1918304.5, dated Jun. 5, 2020, six pages.

*Primary Examiner* — Gustavo Polo
(74) *Attorney, Agent, or Firm* — Fenwick & West LLP

(57) ABSTRACT

A display device includes a display panel, a driving circuit, a sensing circuit, and a compensation circuit. The display panel includes a first pixel and a second pixel. The driving circuit provides a preset sensing voltage to the first pixel of the display panel, and provides a dummy voltage to the second pixel of the display panel. A first channel of a sensing circuit generates a first integrated voltage signal indicative of a magnitude of a first pixel current generated by the first pixel. A second channel of the sensing circuit generates a second integrated voltage signal indicative of a magnitude of a first dummy current generated by the second pixel. The compensation circuit determines a compensation amount from a difference between an output of the first and second channels of the sensing circuit, and compensates a display voltage of the first pixel by the compensation amount.

18 Claims, 13 Drawing Sheets

ORGANIC LIGHT EMITTING DISPLAY DEVICE AND PIXEL SENSING METHOD OF THE SAME

CROSS REFERENCE TO RELATED APPLICATIONS

This application claims the benefit of Korea Patent Application No. 10-2018-0166699 filed on Dec. 20, 2018, which is incorporated herein by reference for all purposes as if fully set forth herein.

BACKGROUND

Field of the Technology

The present disclosure relates to an organic light emitting display device.

Discussion of the Related Art

An organic light emitting display device of an active matrix type arranges the pixels each including an organic light emitting diode OLED, a driving Thin Film Transistor TFT in a matrix form and controls the luminance of the image represented in the pixels according to the grayscale of image data. The driving TFT controls the pixel current flowing through the OLED according to the voltage applied between a gate electrode and a source electrode of the driving TFT (hereinafter, it is called as gate-source voltage). The amount of light emitted by the OLED and the luminance of a screen are determined according to the pixel current.

Since the threshold voltage and electron mobility of the driving TFT, the operating point voltage of the OLED and the like determine the driving characteristics of a pixel, the characteristics of all pixels must be same. However, due to various causes such as process properties, time varying properties and the like, the driving characteristics become different among the pixels. Such a difference in driving characteristic causes a luminance deviation, which is a limitation in displaying image as desired quality. As a method of compensating for the luminance deviation between pixels, the external compensating scheme is known which senses the driving characteristics of pixels and adjusts input image data based on the sensing results.

SUMMARY

In a compensation technique, there is a method of sensing a pixel current flowing through a driving TFT using a current integrator in order to sense driving characteristics of a pixel. This method determines a change in a pixel current using the voltage difference between an integral reference voltage and an integral output voltage.

The current integrator is connected to each pixel through a sensing line in a display panel. So, common noise of the display panel may be reflected on the pixel current sensed through the current integrator. The common noise of the panel may be caused by various causes such as process characteristics, driving environment, etc., and may affect respective sensing channels in different sizes. This common noise is amplified by an integral amplifier to distort the integral output voltage, so that sensing results may vary between current integrators even when sensing a same pixel current.

So, the present disclosure provides an organic light emitting display and a method of sensing pixels of the organic light emitting display, which can improve sensing accuracy and sensing reliability by minimizing the influence of the common noise.

Embodiments are directed to a display device having a display panel, a driving circuit, a sensing circuit, and a compensation circuit. The display panel includes a first pixel and a second pixel. The driving circuit provides a preset sensing voltage to the first pixel of the display panel, and provides a dummy voltage to the second pixel of the display panel. The sensing circuit senses a current generated by the first and second pixels. The sensing circuit includes a first and second channels. The first channel generates a first integrated voltage signal indicative of a magnitude of a first pixel current generated by the first pixel in response to the sensing voltage. The second channel generates a second integrated voltage signal indicative of a magnitude of a first dummy current generated by the second pixel in response to the dummy voltage. The compensation circuit determines a first compensation amount from a difference between an output of the first and second channels of the sensing circuit. Moreover, the compensation circuit compensates a display voltage of the first pixel by the determined first compensation amount in a subsequent display frame of the display device.

In some embodiments, the first channel comprises a first amplifier, a first feedback capacitor, and a first reset switch. The first amplifier has a first input terminal receiving a reference voltage and a second input terminal coupled to the first pixel for receiving the first pixel current. The first feedback capacitor is coupled between the second input terminal of the first amplifier and an output of the first amplifier. The first reset switch is coupled between the second input terminal of the first amplifier and the output of the first amplifier.

Moreover, the second channel comprises second amplifier, a second feedback capacitor, and a second reset switch. The second amplifier has a first input terminal receiving the reference voltage and a second input terminal coupled to the second pixel for receiving the first dummy current. The second feedback capacitor is coupled between the second input terminal of the second amplifier and an output of the second amplifier. The second reset switch is coupled between the second input terminal of the second amplifier and the output of the second amplifier.

In some embodiments, the first reset switch is closed to initialize the output of the first amplifier to be the reference voltage. Moreover, the first reset switch is opened after the output of the first amplifier has been initialized. In addition, the second reset switch is closed to initialize the output of the second amplifier to be the reference voltage, and is opened after the output of the second amplifier has been initialized.

In some embodiments, the dummy voltage is higher than a data voltage of black grayscale and lower than the reference voltage.

In some embodiments, the sensing voltage is greater than the reference voltage.

In some embodiments, the driving circuit is further configured to provide the dummy voltage to the first pixel and provide the sensing voltage to the second pixel. The first channel is further configured to generate a third integrated voltage signal indicative of a magnitude of a second dummy current generated by the first pixel in response to the dummy voltage. The second channel is further configured to generate a fourth integrated voltage signal indicative of a magnitude of a second pixel current generated by the second pixel in response to the sensing voltage. The compensation circuit is further configured to determine a second compensation amount from a difference between an output of the first and second channels of the sensing circuit, and compensating a display voltage of the second pixel by the determined second compensation amount in subsequent display frames of the display device.

In some embodiments, the first compensation amount for the first pixel and the second compensation amount for the second pixel are determined during a first sensing period and a second sensing period, respectively.

In some embodiments, one frame period comprises a vertical active period in which a data voltage for displaying is applied to the first and second pixels, and a vertical blank period including the first and second sensing periods. The vertical blank period further comprises a transient period between the vertical active period and the first sensing period. The driving circuit is configured to supply the data voltage for displaying to the first and second pixels during the vertical active period, supply the sensing voltage to the first pixel and the dummy voltage to the second pixel during the transient period and the first sensing period, and supply the dummy voltage to the first pixel and the sensing voltage to the second pixel during the second sensing period.

In some embodiments, the sensing circuit further comprises a sample and hold circuit performing a correlated-double-sampling of the first integrated voltage and the second integrated voltage during the first sensing period, and a correlated-double-sampling of the third integrated voltage and the fourth integrated voltage during the second sensing period.

In some embodiments, the sample and hold circuit is configured to remove a common noise current included in the first pixel current based on the first integrated voltage and the second integrated voltage during the first sensing period, and remove the common noise current included in the second pixel current based on the third integrated voltage and the fourth integrated voltage during the second sensing period.

In some embodiments, the first compensation amount for the first pixel and the second compensation amount for the second pixel are determined during the vertical blank period.

In addition, some embodiments are directed to method for sensing pixels of display device. A preset sensing voltage is provided to a first pixel of the display device, and a dummy voltage is provided to a second pixel of the display device. A first pixel current is received from the first pixel. The first pixel current is based on the provided sensing voltage. A first dummy current is received from the second pixel. The first dummy current is based on the provided dummy voltage. A first integrated voltage signal indicative of a magnitude of the first pixel current is generated. A second integrated voltage signal indicative of a magnitude of the first dummy current is generated. A difference between the first integrated voltage signal and the second integrated voltage signal is determined, and a first compensation amount is determined from the determined difference. A display voltage of the first pixel is compensated based on the determined first compensation amount in a subsequent display frame of the display device.

In some embodiments, the first integrated voltage is generated by initializing an output of a first integrator circuit to have a reference voltage level, and integrating the received first pixel current to modify the output of the integrator circuit with a rate according to a magnitude of the first pixel current.

In some embodiments, the dummy voltage is higher than a data voltage level of black grayscale and lower than the reference voltage level. The voltage level of the black grayscale is capable of turning the first and second pixels off.

In some embodiments, the sensing voltage is greater than the reference voltage level.

In some embodiments, a dummy voltage is provided to the first pixel of the display device, and the sensing voltage is provided to the second pixel of the display device. A second dummy current is received from the first pixel, and a second pixel current is received from the second pixel. A third integrated voltage signal indicative of a magnitude of the second dummy current and a fourth integrated voltage signal indicative of a magnitude of the second pixel current are generated. Based on a difference between the third and fourth integrated voltage signals, a second compensation amount is determined. A display voltage of the second pixel is compensated based on the determined second compensation amount in a subsequent display frame of the display device.

In some embodiments, the first compensation amount for the first pixel and the second compensation amount for the second pixel are determined during a first sensing period and a second sensing period, respectively.

In some embodiments, one frame period comprises a vertical active period in which a data voltage for displaying is applied to the first and second pixels, and a vertical blank period including the first and second sensing periods. In addition, the vertical blank period further comprises a transient period between the vertical active period and the first sensing period. Moreover, the sensing voltage is provided to the first pixel and the dummy voltage is provided to the second pixel during the transient period and the first sensing period, and the dummy voltage is provided to the first pixel and the sensing voltage is provided to the second pixel during the second sensing period.

In some embodiments, the difference between the first integrated voltage signal and the second integrated voltage signal is determined by performing a correlated-double-sampling of the first integrated voltage and the second integrated voltage during the first sensing period. Moreover, the difference between the third integrated voltage signal and the fourth integrated voltage signal is determined by performing a correlated-double-sampling of the third integrated voltage and the fourth integrated voltage during the second sensing period.

In some embodiment, the compensation amount for the first pixel and the second compensation amount for the second pixel are determined during the vertical blank period.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
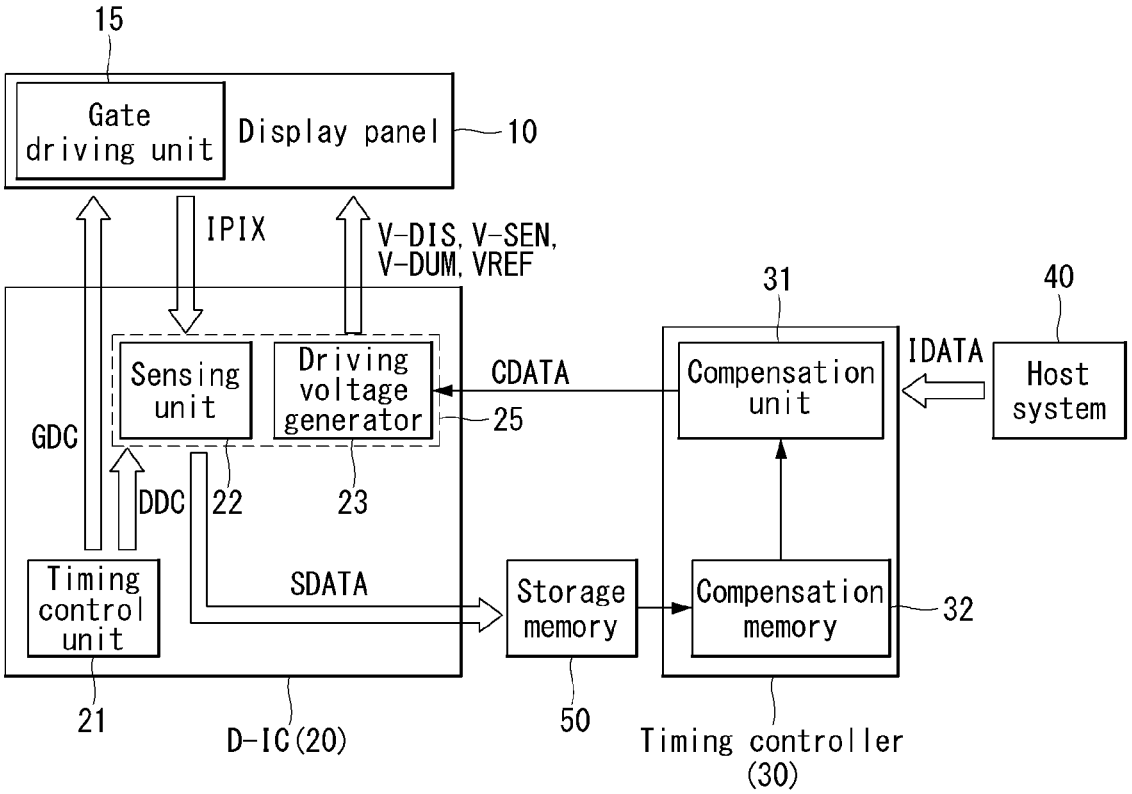
FIG. 1 shows a block diagram illustrating an organic light emitting display device according to an embodiment of the present disclosure.

The advantages and features of the present disclosure and methods of accomplishing the same may be understood more readily by reference to the following detailed descriptions of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the present disclosure to those skilled in the art, and the present disclosure is defined by the appended claims.

The shapes, sizes, percentages, angles, numbers, etc. shown in the figures to describe the exemplary embodiments of the present disclosure are merely examples and not limited to those shown in the figures. Like reference numerals denote like elements throughout the specification. When the terms 'comprise', 'have', 'consist of' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms 'on', 'over', 'under', 'next to' and the like, one or more parts may be positioned between the two parts as long as the term 'immediately' or 'directly' is not used.

It will be understood that, although the terms first, second, etc., may be used to describe various elements, these elements should not be limited by these terms. These terms are only used to distinguish one element from another element. Thus, a first element referred to below may be a second element within the scope of the present disclosure.

In this specification, the pixel circuit and the gate driver formed on the substrate of a display panel may be implemented by a TFT of an n-type MOSFET structure, but the present disclosure is not limited thereto so the pixel circuit and the gate driver may be implemented by a TFT of a p-type MOSFET structure. The TFT or the transistor is the element of 3 electrodes including a gate, a source and a drain. The source is an electrode for supplying a carrier to the transistor. Within the TFT the carrier begins to flow from the source. The drain is an electrode from which the carrier exits the TFT. That is, the carriers in the MOSFET flow from the source to the drain. In the case of the n-type MOSFET NMOS, since the carrier is an electron, the source voltage has a voltage lower than the drain voltage so that electrons can flow from the source to the drain. In the n-type MOSFET, a current direction is from the drain to the source because electrons flow from the source to the drain. On the other hand, in the case of the p-type MOSFET PMOS, since the carrier is a hole, the source voltage has a voltage higher than the drain voltage so that holes can flow from the source to the drain. In the p-type MOSFET, a current direction is from the source to the drain because holes flow from the source to the drain. It should be noted that the source and drain of the MOSFET are not fixed. For example, the source and drain of the MOSFET may vary depending on the applied voltage. Therefore, in the description of the present disclosure, one of the source and the drain is referred to as a first electrode, and the other one of the source and the drain is referred to as a second electrode.

In this specification, the semiconductor layer of the TFT may be implemented by at least one of an oxide element, an amorphous silicon element, and a polysilicon element.

Figure 2:
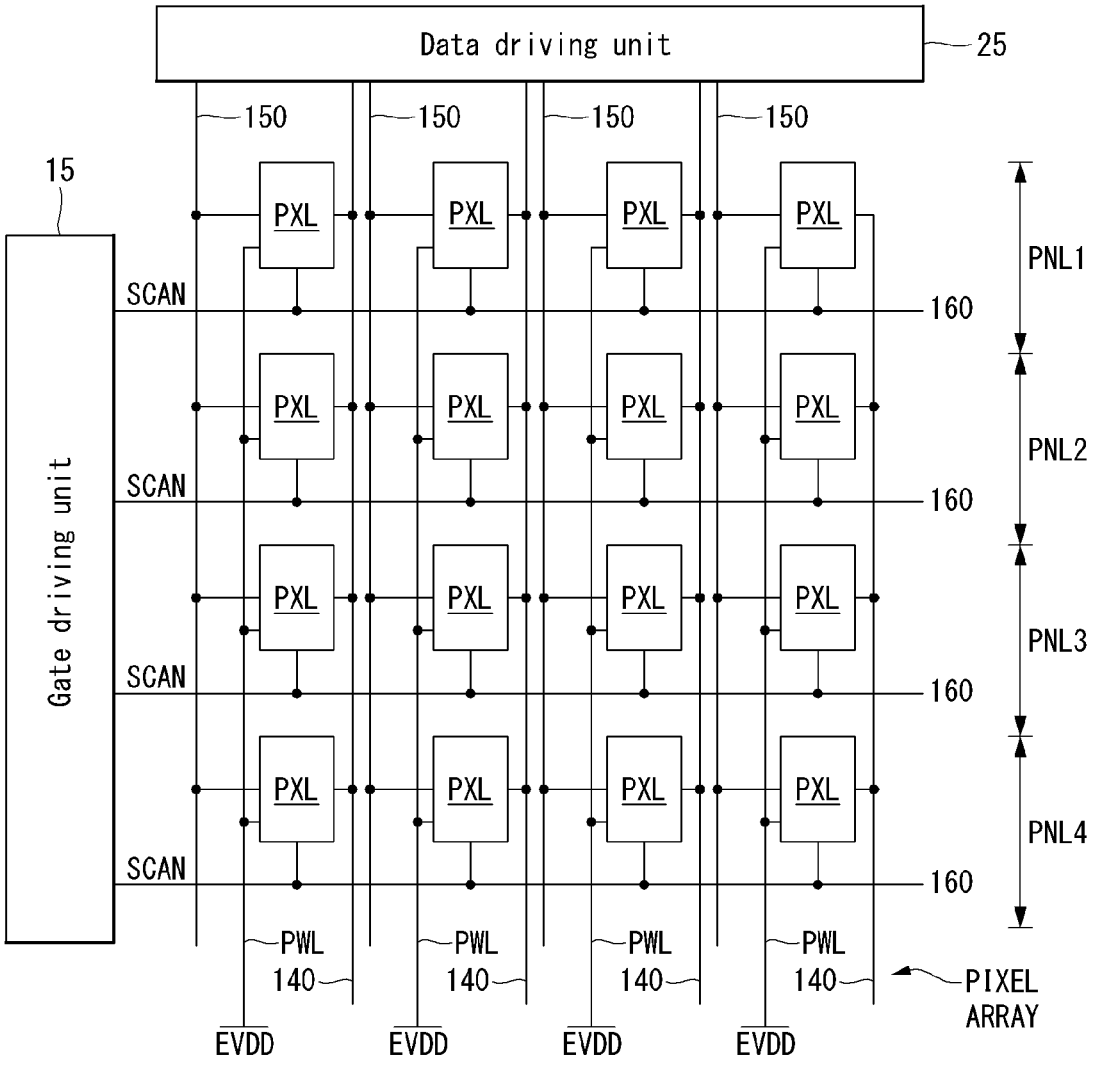
FIG. 2 shows a pixel array equipped in the display panel of FIG. 1.

FIG. 1 shows a block diagram illustrating an organic light emitting display device according to an embodiment of the present disclosure, and FIG. 2 shows a pixel array equipped in the display panel of FIG. 1.

Referring to FIGS. 1 and 2, the organic light emitting display device according to the present disclosure may comprise a display panel 10, a drive IC D-IC 20, a timing controller 30, a host system 40 and a storage memory 50. The panel driving unit of the present disclosure may include a gate driving unit 15 equipped in the display panel 10 and a data driving unit 25 embedded in the driver IC D-IC 20.

The display panel 10 is equipped with a plurality of pixel lines PNL1~PNL4, and each pixel line is equipped with a plurality of pixels PXL and a plurality of signal lines. The pixel line in the present disclosure does not mean a physical signal line, but means a collection of the pixels PXL adjacent to each other along the direction in which a gate line extends and the signal lines. The signal lines may include the data lines 140 for supplying to the pixels PXL the data voltage V-DIS for displaying, the data voltage V-SEN for sensing and a dummy data voltage V-DUM, the reference voltage lines 150 for supplying a reference voltage VREF to the pixels PXL, the gate lines 160 for supplying gate signals to the pixels PXL and high potential power lines PWL for supplying a high potential pixel voltage to the pixels PXL.

The pixels PXL in the display panel 10 are arranged in a matrix form to constitute a pixel array. Each pixel PXL included in the pixel array in FIG. 2 may be connected to one of the data lines 140, one of the reference voltage lines 150, one of the high potential power lines PWL and one of the gate lines 160. A plurality of pixels PXL included in the pixel array in FIG. 2 may be connected to one of a plurality of the gate lines 160. And, a low potential pixel voltage may be supplied to each pixel PXL included in the pixel array in FIG. 2 from a power generating unit. The power generating unit may supply the low potential pixel voltage to the pixels PXL through a low potential power line or a padding unit.

The gate driving unit 15 may be embedded in the display panel 10.

The gate driving unit 15 may include a plurality of stages connected to the gate lines 160 of the pixel array in FIG. 2. The stages may generate the gate signals for controlling the switch elements included in the pixels PXL and supply them to the gate lines 160.

The driver IC D-IC 20 may include a timing control unit 21 and a data driving unit 25. The timing control unit 21 may also be embedded in the timing controller 30. The data driving unit 25 may include a sensing unit 22 and a driving voltage generator 23, but is not limited thereto.

The timing control unit 21 may generate the gate timing control signals GDC for controlling the operating timings of the gate driving unit 15 and the data timing control signals DDC for controlling the operating timings of the data driving unit 25, based on the timing signals input from the host system 40, for example a vertical synchronization signal Vsync, a horizontal synchronization signal Hsync, a dot clock signal DCLK, a data enable signal DE, and so on.

The data timing control signals DDC may include a source start pulse, a source sampling clock, a source output enable signal, and so on, but are not limited thereto. The source start pulse controls a data sampling start timing of the driving voltage generator 23. The source sampling clock is a clock signal for controlling a data sampling timing based on a rising or falling edge. The source output enable signal controls an output timing of the driving voltage generator 23.

The gate timing control signals GDC may include a gate start pulse, a gate shift clock, and so on, but are not limited thereto. The gate start pulse is applied to the stage of generating a first scan signal to activate the stage. The gate shift clock is commonly supplied to the gate stages to shift the gate start pulse.

The timing control unit 21 may sense driving characteristics of the pixels in a vertical blank period of each frame by controlling driving timings of the panel driving unit. The vertical blank period is disposed between adjacent vertical active periods and a period in which the writing of image data is suspended. The vertical active period is a period in which the image data to be displayed is written in the display panel 10. The driving characteristics of the pixels PXL include a threshold voltage and electron mobility of a driving element and a driving point voltage of a light emitting element included in each pixel PXL.

The timing control unit 21 controls the timings of sense driving and display driving for the pixel lines PNL1~PNL4 of the display panel 10 according to a predetermined sequence, thereby implementing the display driving and the sense driving.

The timing control unit 21 may generate the timing control signals GDC and DDC for the display driving and the timing control signals GDC and DDC for the sense driving. Sense driving means the operations of writing the data voltage V-SEN for sensing and the dummy data voltage V-DUM to the pixels PXL of a pixel line to be sensed, sensing the driving characteristics of the pixels PXL, and updating compensation values for compensating for the change of the driving characteristics of the pixels PXL based on the sensing result data SDATA. Display driving means the operations of correcting the digital image data to be input to the pixels PXL based on the updated compensation values, and applying the data voltages V-DIS for displaying an image corresponding to the corrected image data CDATA to the pixels thereby displaying input image on the display panel 10.

The driving voltage generator 23 is implemented by a digital-to-analog converter DAC converting a digital signal into an analog signal. The driving voltage generator 23 generates the data voltage V-SEN for sensing and the dummy data voltage V-DUM necessary for the sense driving and the data voltage V-DIS for displaying necessary for the display driving and supplies them to the data lines 140. The driving voltage generator 23 may generate a reference voltage VREF further necessary for the sense driving and the display driving and supply it to the reference voltage lines 150.

The data voltage V-DIS for displaying is a result of the digital-to-analog conversion for the digital image data CDATA corrected in the timing controller 30, and may be different from each other in its magnitude in a unit of a pixel depending on a grayscale value and a compensation value. The data voltage V-SEN for sensing is differently set in units of R (red), G (green), B (blue), and W (white) pixels in consideration that the driving characteristics of the driving elements for respective colors of pixels are different from each other. The data voltage V-SEN for sensing is set as a magnitude capable of turning on the driving element of the pixel PXL. Corresponding to the data voltage V-SEN for sensing, a pixel current to be sensed flows in the corresponding pixel PXL. The dummy data voltage V-DUM is for extracting the common noise component of the panel, and set to be higher than a data voltage for black grayscale and lower than an integral reference voltage of the sensing unit 22. The data voltage of the black grayscale and the dummy data voltage V-DUM are set to be a magnitude capable of turning off the driving element of a pixel PXL. Corresponding to the dummy data voltage V-DUM, a common noise current to be sensed flows in the corresponding pixel PXL. The reason that the dummy data voltage V-DUM is set to be higher than the data voltage for the black grayscale is for minimizing the influence of parasitic capacitance and reducing a sensing error by reducing the voltage difference from the data voltage V-DIS for displaying and the voltage difference from the data voltage V-SEN for sensing.

The sensing unit 22 may sense the driving characteristics of the pixels PXL through sensing lines for the sense driving. The sensing lines may be implemented by the data lines 140 or the reference voltage lines 150. In an embodiment of the present disclosure, the sensing lines are explained to be implemented by the reference voltage lines 150. The sensing unit 22 may be implemented as a current sensing type that senses a pixel current flowing in one pixel PXL and a common noise current flowing in another pixel PXL and removes a common noise component from the pixel current by using a correlation double sampling method. The sensing unit 22 may comprise a current integrator and a sample and hold unit, which will be described in detail with reference to FIG. 9

The sensing unit 22 may simultaneously process a plurality of analog sensing values in parallel by using a plurality of ADCs, and may process the plurality of analog sensing values in a sequential manner using one ADC. The sampling rate and accuracy of the ADC are trade-offed to each other. The ADC of a parallel processing method have the advantage of increasing sensing accuracy because it can slow down a sampling rate compared to the ADC of a serial processing manner. The ADC may be implemented as the ADC of a flash type, the ADC using a tracking scheme, the ADC of a successive approximation register type, and so on. The ADC converts analog sensing values into digital sensing result data SDATA within a predetermined sensing range, and supplies the digital sensing result data SDATA to the storage memory 50.

The storage memory 50 stores the digital sensing result data SDATA input from the sensing unit 22 in sense driving. The storage memory 50 may be implemented as a flash memory, but not limited thereto.

The timing controller 30 may include a compensating unit 31 and a compensating memory 32. The compensating memory 32 transmits the digital sensing result data SDATA read from the storage memory 50 to the compensating unit 31. The compensating memory 32 may be a random access memory RAM, for instance a double date rate synchronous dynamic RAM, but not limited thereto. The compensating unit 31 calculates a compensating offset and a compensating gain for each pixel based on the digital sensing result data SDATA read from the storage memory 50, corrects the image data input from the host system 40 according to the compensating offset and gain, and supplies the corrected image data CDATA to the driver IC 20.

Figure 3:
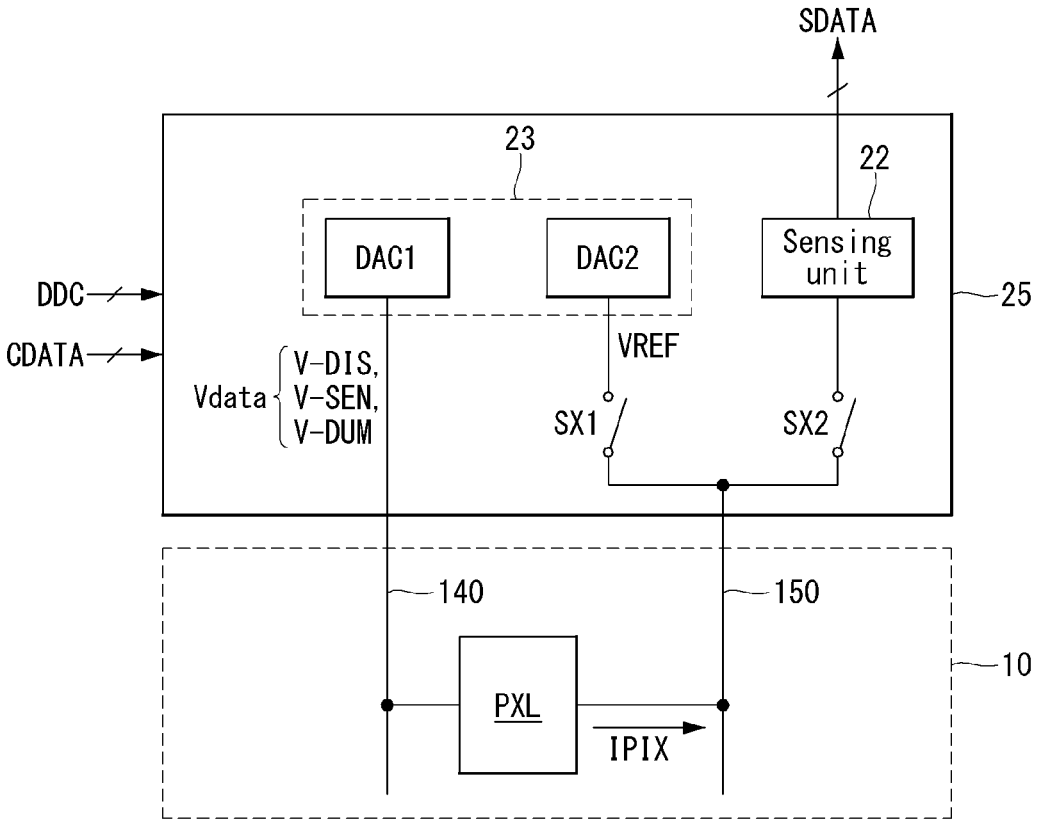
FIG. 3 shows the configuration of the data driving unit connected to the pixel array of FIG. 2.

FIG. 3 shows the configuration of the data driving unit connected to the pixel array of FIG. 2. The data driving unit 25 in FIG. 3 senses the driving characteristics of the pixels PXL through the reference voltage line 150.

Referring to FIG. 3, the data driving unit 25 may be connected to the first node of the pixel PXL (the gate electrode of a driving element) through the data line 140, and connected to the second node of the pixel PXL (the source electrode of the driving element) through the reference voltage line 150. Since a pixel current IPIX flows through the second node of the pixel PXL, the reference voltage line 150 connected to the second node via a second switching element may be used as a sensing line.

The reference voltage line 150 is selectively connected to the driving voltage generator 23 and the sensing unit 22 through connecting switches SX1 and SX2. The driving voltage generator 23 may comprise a first driving voltage generator DAC1 for generating the data voltage Vdata, and a second driving voltage generator DAC2 for generating the reference voltage VREF.

The data voltage Vdata includes the data voltage V-SEN for sensing, the data voltage V-DIS for displaying and the dummy data voltage V-DUM. The data voltage V-DIS for displaying is applied to a gate electrode of a driving element included in each pixel PXL in the display driving. The reference voltage VREF is applied to a source electrode of the driving element included in each pixel PXL in the display driving. The data voltage V-SEN for sensing and the dummy data voltage V-DUM are applied to the gate electrodes of the driving elements included in the pixels PXL to be sensed in the sense driving. An integral reference voltage may be applied to the source electrodes of the driving elements included in the pixels PXL to be sensed in the sense driving. The integral reference voltage and the reference voltage VREF are respectively used to program a gate-source voltage of the driving element in the sense driving and the display driving, and may be set to be a same level or different levels from each other.

The first connecting switch SX1 is connected between the reference voltage line 150 and the second driving voltage generator DAC2, and the second connecting switch SX2 is connected between the reference voltage line 150 and the sensing unit. The first and second connecting switches SX1 and SX2 are selectively turned on. Only the first connecting switch SX1 is turned on in synchronization with the timing at which the reference voltage VREF is applied to the pixel PXL, and only the second connecting switch SX2 is turned on in synchronization with the timing at which the pixel current flowing through the pixel PXL is sensed. So, the reference voltage line 150 is selectively connected to the second driving voltage generator DAC2 and the sensing unit 22 via the first and second connecting switches SX1 and SX2.

Figure 4:
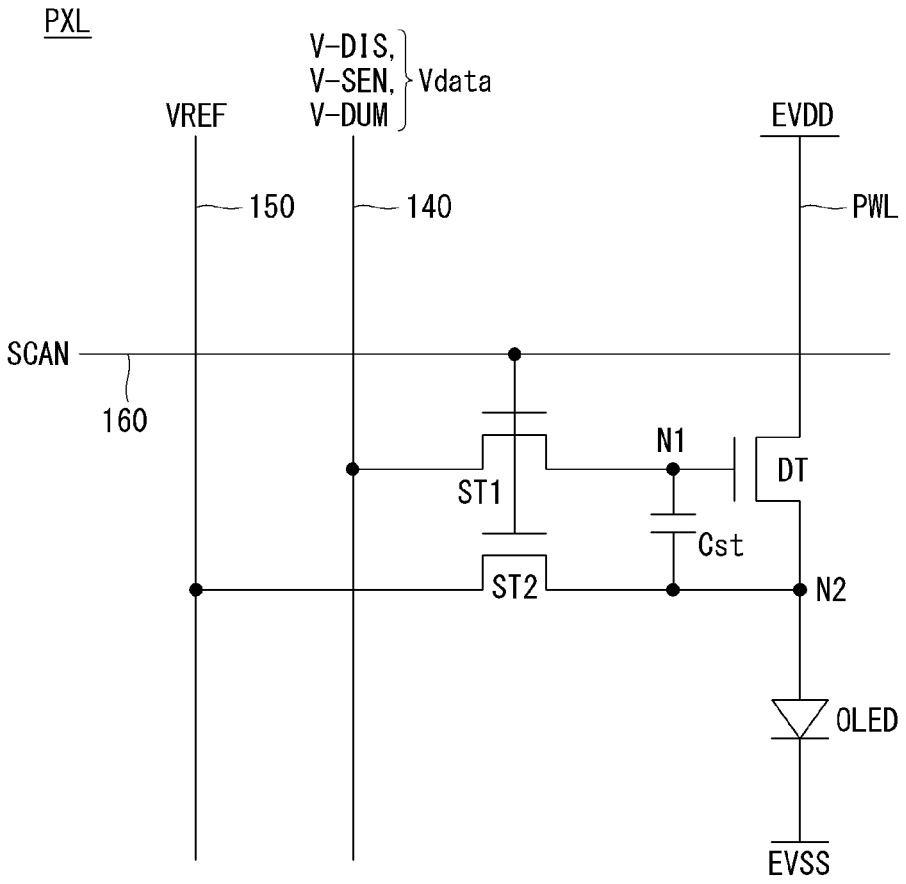
FIG. 4 shows an equivalent circuit of the pixel shown in FIG. 3.

FIG. 4 shows an equivalent circuit of the pixel shown in FIG. 3.

Referring to the FIG. 4, the pixel PXL utilizing the reference voltage line 150 as the sensing line comprises an OLED, a driving TFT DT, switching TFTs ST1 and ST2, and a storage capacitor Cst. The driving TFT DT and the switching TFTs ST1 and ST2 are implemented as NMOS, but not limited thereto.

The OLED is an element capable of emitting light with the intensity corresponding to the pixel current input from the driving TFT DT. An anode electrode of the OLED is connected to a second node N2 and a cathode node of the OLED is connected to an input terminal of a low potential voltage EVSS.

The driving TFT DT is a driving element for generating the pixel current according to the voltage difference between a gate electrode and a source electrode (gate-source voltage). The driving TFT DT comprises the gate electrode connected to a first node N1, the first electrode connected to an input terminal a high potential voltage EVDD through the high potential power line PWL, and a second electrode connected to a second node N2. The common noise current may be included in the pixel current. The common noise current may be caused by various causes such as process characteristics, driving environment, and the like. The common noise current may flow through the driving TFT DT when the driving TFT DT is turned off as well as when the driving TFT DT is turned on.

The switching TFTs ST1 and ST2 are the switching elements that establish the gate-source voltage of the driving TFT DT and the second switching TFT ST2 connects the second electrode of the driving TFT DT and the reference voltage line 150.

The first switching TFT ST1 is connected between the data line 140 and the first node N1 to be turned on according to the gate signal SCAN from the gate line 160. The first switching TFT ST1 is turned on when programming pixels in the display driving or the sense driving. When the first switching TFT ST1 is turned on, one of the data voltage V-DIS for displaying, the data voltage V-SEN for sensing and the dummy data voltage V-DUM is applied to the first node N1. A gate electrode of the first switching TFT ST1 is connected to the gate line 160, a first electrode of the first switching TFT ST1 is connected to the data line 140 and a second electrode of the first switching TFT ST1 is connected to the first node N1.

The second switching TFT ST2 is connected between the reference voltage line 150 and the second node N2 to be turned on according to the gate signal SCAN from the gate line 160. The second switching TFT ST2 is turned on when programming pixels in the display driving or the sense driving, thereby applying the reference voltage VREF or the integral reference voltage to the second node N2. Also, the second switching TFT ST2 is turned on when sensing the pixel in the sense driving, thereby applying the pixel current or the common noise current flowing through the driving TFT DT to the reference voltage line 150. A gate electrode of the second switching TFT ST2 is connected to the gate line 160, a first electrode of the second switching TFT ST2 is connected to the reference voltage line 150 and a second electrode of the second switching TFT ST2 is connected to the second node N2.

The storage capacitor Cst is connected between the first node N1 and the second node N2 to maintain the gate-source voltage of the driving TFT DT for a certain period.

Figure 5:
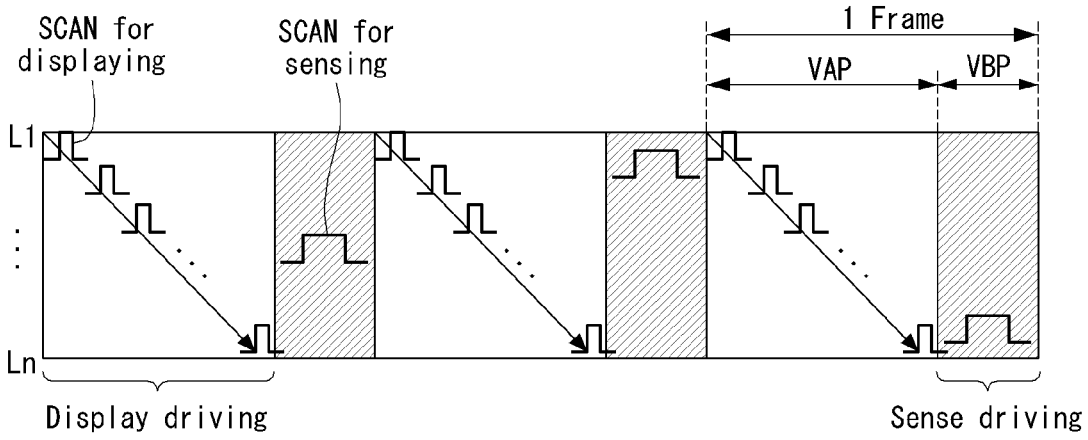
FIG. 5 shows the timings at which display driving and sense driving are performed within one frame.

FIG. 5 shows the timings at which display driving and sense driving are performed within one frame.

Referring to FIG. 5, the display driving of the present disclosure is performed in the vertical active period VAP and the sense driving of the present disclosure is performed in the vertical blank period VBP. That is, the sense driving of the present disclosure is performed in real time during displaying image on the display panel. By sensing the driving characteristics of the pixels PXL in real time during displaying image, it is possible to quickly compensate for the driving characteristics continuously changing during displaying image.

The sense driving is performed for each pixel line per vertical blanking period, and at this time the emission of the pixels PXL included in the corresponding pixel line is stopped. This is for increasing the sensing accuracy. Since the pixel line is sensed with the screen turned on in the vertical blank period, the pixel line being sensed may be noticeable. In this case, the emission time of the pixel line to be sensed must be shorter than the emission time of the pixel lines which are not being sensed. In order to reduce the visibility of the line dim due to the difference in light emission times, the position of the pixel line to be sensed is changed for each frame and may be changed irrespective of the scan order for displaying, that is, randomly.

Figure 6:
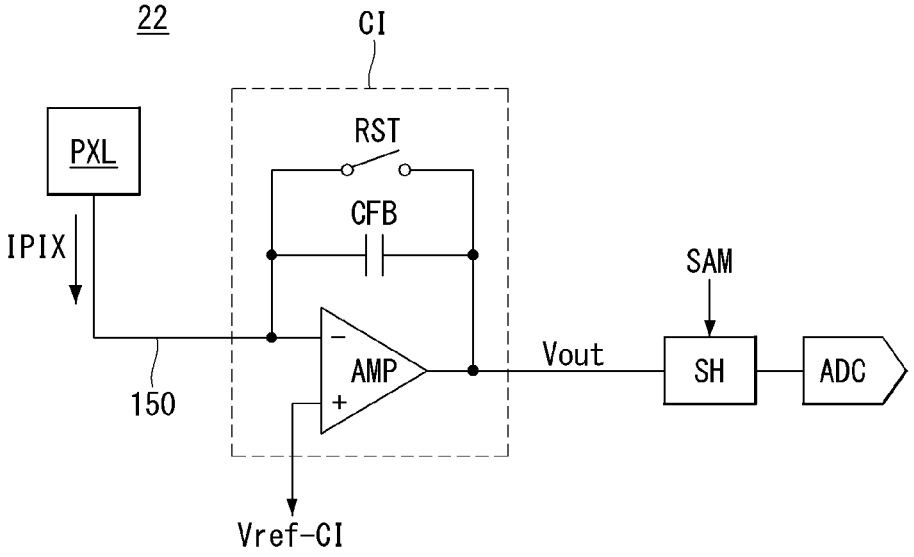
FIG. 6 shows a configuration of a sensing unit connected to each pixel through a sensing line.
Figure 7:
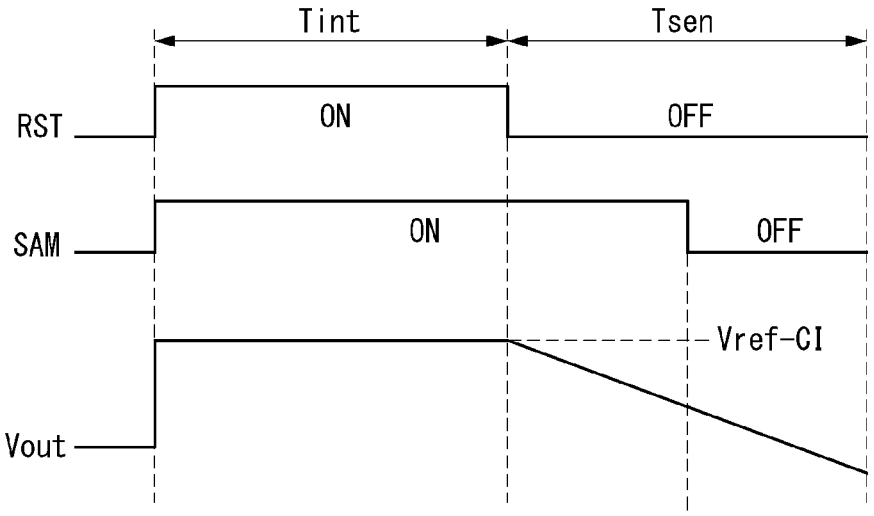
FIG. 7 shows driving waveforms of the sensing unit.

FIG. 6 shows a configuration of a sensing unit connected to each pixel through a sensing line, and FIG. 7 shows driving waveforms of the sensing unit.

Referring to FIG. 6, the sensing unit 22 may comprise a current integrator CI, a sample and hold unit SH and an ADC.

The current integrator CI is connected to a pixel PXL through a sensing line of the display panel 10. The current integrator CI supplies an integral reference voltage Vref-CI to the pixel PXL through the sensing line 150, then senses a pixel current IPIX flowing in the pixel PXL. The current integrator CI generates an integral output voltage Vout varying from the integral reference voltage Vref-CI by integrating the pixel current IPIX flowing from the pixel PXL. Also, the current integrator CI may generate the integral output voltage Vout varying from the integral reference voltage Vref-CI by further integrating a common noise current flowing in the pixel PXL.

The current integrator CI comprises an integral amplifier AMP, an integral capacitor CFB and a reset switch RST. The integral amplifier AMP includes a first input terminal which receives the pixel current IPIX or the common noise current through the sensing line 150, a second input terminal which receives the integral reference voltage Vref-CI and an output terminal outputting an integral output voltage which is an integral result for the pixel current IPIX. The integral capacitor CFB is connected between the first input terminal and the output terminal. The reset switch RST is further connected between the first input terminal and the output terminal of the integral amplifier AMP in parallel with the integral capacitor CFB.

As shown in FIG. 7, the reset switch RST of the current integrator CI is turned on in a programming period Tint and turned off in a sensing period Tsen. In the programming period Tint, the sensing line 150, a source electrode of the driving element and the output terminal of the current integrator CI are initialized to the integral reference voltage Vref-CI according to the turn-on of the reset switch RST. At this time, the data voltage for sensing or the dummy data voltage is applied to a gate electrode of the driving element. In the sensing period Tsen, the pixel current or the common noise current flowing through the driving element is accumulated in the integral capacitor CFB of the current integrator CI through the sensing line 150 according to the turn-off of the reset switch RST.

The integral amplifier Amp may be implemented as a negative type or a positive type. In the integral amplifier AMP of the negative type, a first input terminal is an inverting input terminal (−) of the integral amplifier AMP and a second input terminal is a non-inverting input terminal (+) of the integral amplifier AMP. In this negative-type amplifier AMP, the integral output voltage Vout gradually decreases from the integral reference voltage Vref-CI as the pixel current IPIX is accumulated in the integral capacitor CFB. The falling slope of the integral output voltage Vout is proportional to the magnitude of the pixel current IPIX.

On the other hand, in the amplifier AMP of the positive type, a first input terminal is a non-inverting input terminal (+) of the integral amplifier and a second input terminal is an inverting input terminal (−) of the integral amplifier. In this positive-type amplifier AMP, the integral output voltage Vout gradually increases from the integral reference voltage Vref-CI as the pixel current IPIX is accumulated in the integral capacitor CFB. The rising slope of the integral output voltage Vout is proportional to the magnitude of the pixel current IPIX.

The present disclosure may be applied to the negative-type amplifier and also applied to the positive-type amplifier. In the embodiment of the present disclosure, the negative-type amplifier will be mainly described for the sake of convenience.

The sample and hold unit SH removes the common noise component from a first integral output voltage Vout by correlated-double-sampling a first integral output voltage Vout which is the sensing result for the pixel current IPIX and a second integral output voltage Vout which is the sensing result for the common noise current. The sample and hold unit SH may comprise a sampling switch operating according to a sampling signal SAM, a sampling capacitor and a holding switch, but is not limited thereto.

The ADC converts the first integral output voltage Vout free from the common noise component into digital sensing result data within a predetermined sensing range.

Figure 8A:
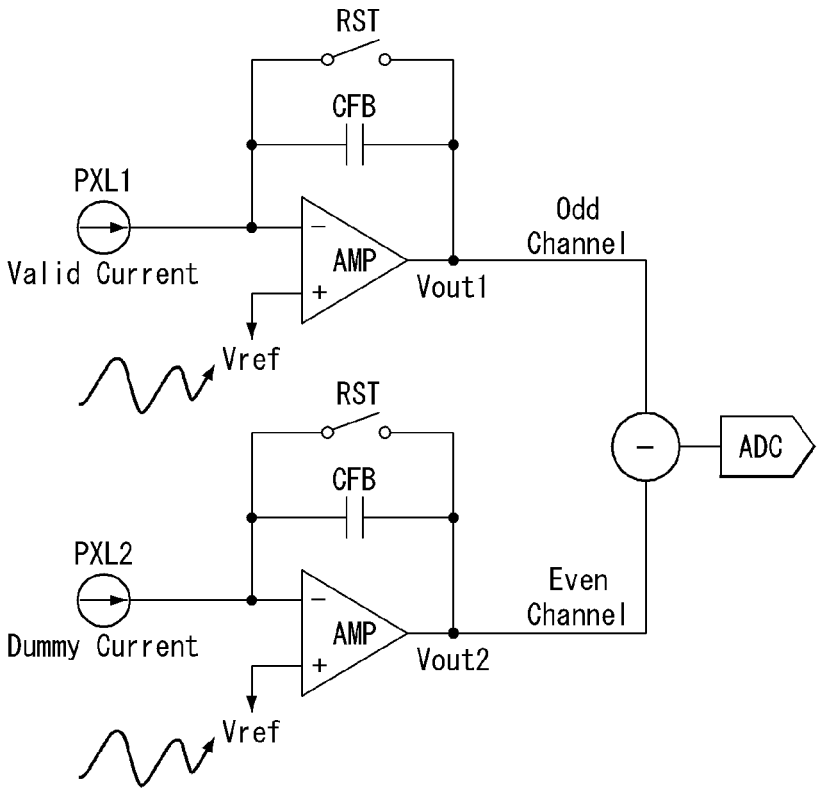
FIGS. 8A and 8B are diagrams for explaining the correlated double sampling method for cancelling the common noise.
Figure 8B:
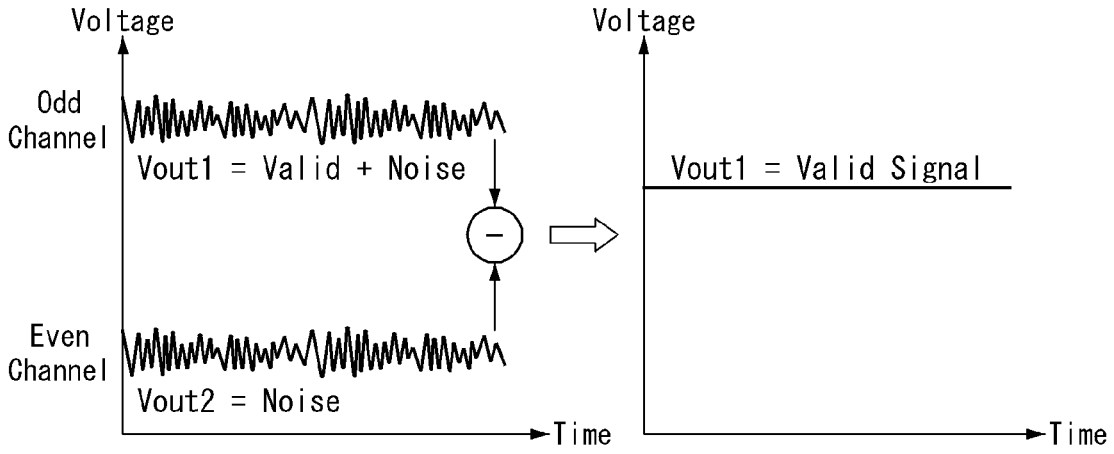

FIGS. 8A and 8B are diagrams for explaining the correlated double sampling method for cancelling the common noise.

Referring to FIGS. 8A and 8B, a first current integrator connected to an odd-numbered sensing channel senses the pixel current of a first pixel PXL1 to output a first integral output voltage Vout1, and a second current integrator connected to an even-numbered sensing channel senses the dummy current (common noise current) of a second pixel PXL2 to output a second integral output voltage Vout2.

The first integral output voltage Vout1 includes the common noise component. The sample and hold unit eliminates the common noise component from the first integral output voltage Vout1 by subtracting the second integral output voltage Vout2 from the first integral output voltage Vout1.

Figure 9:
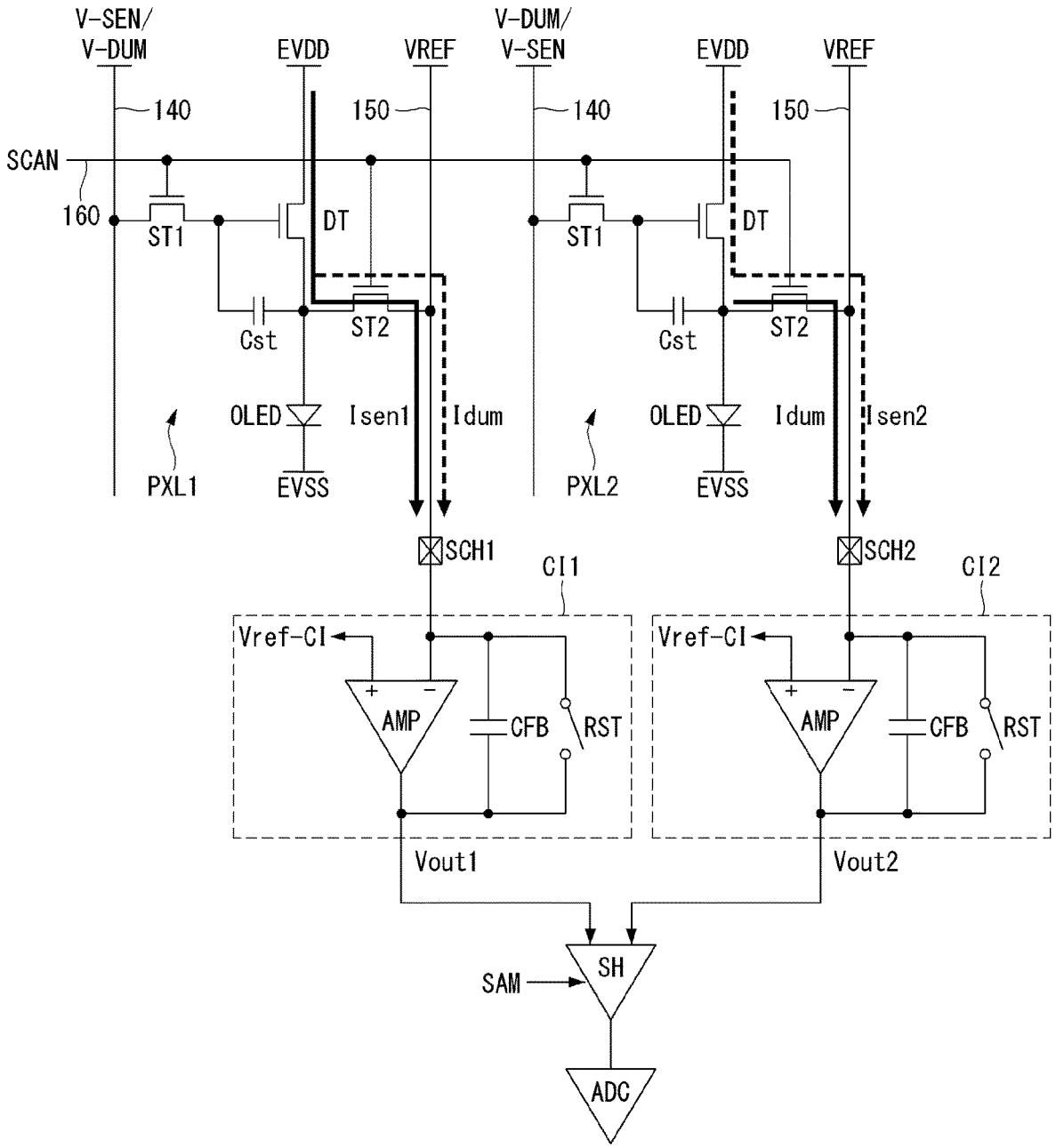
FIGS. 9 and 10 illustrate a pixel sensing method based on a correlated double sampling in the OLED display device according to an embodiment of the present disclosure.
Figure 10:
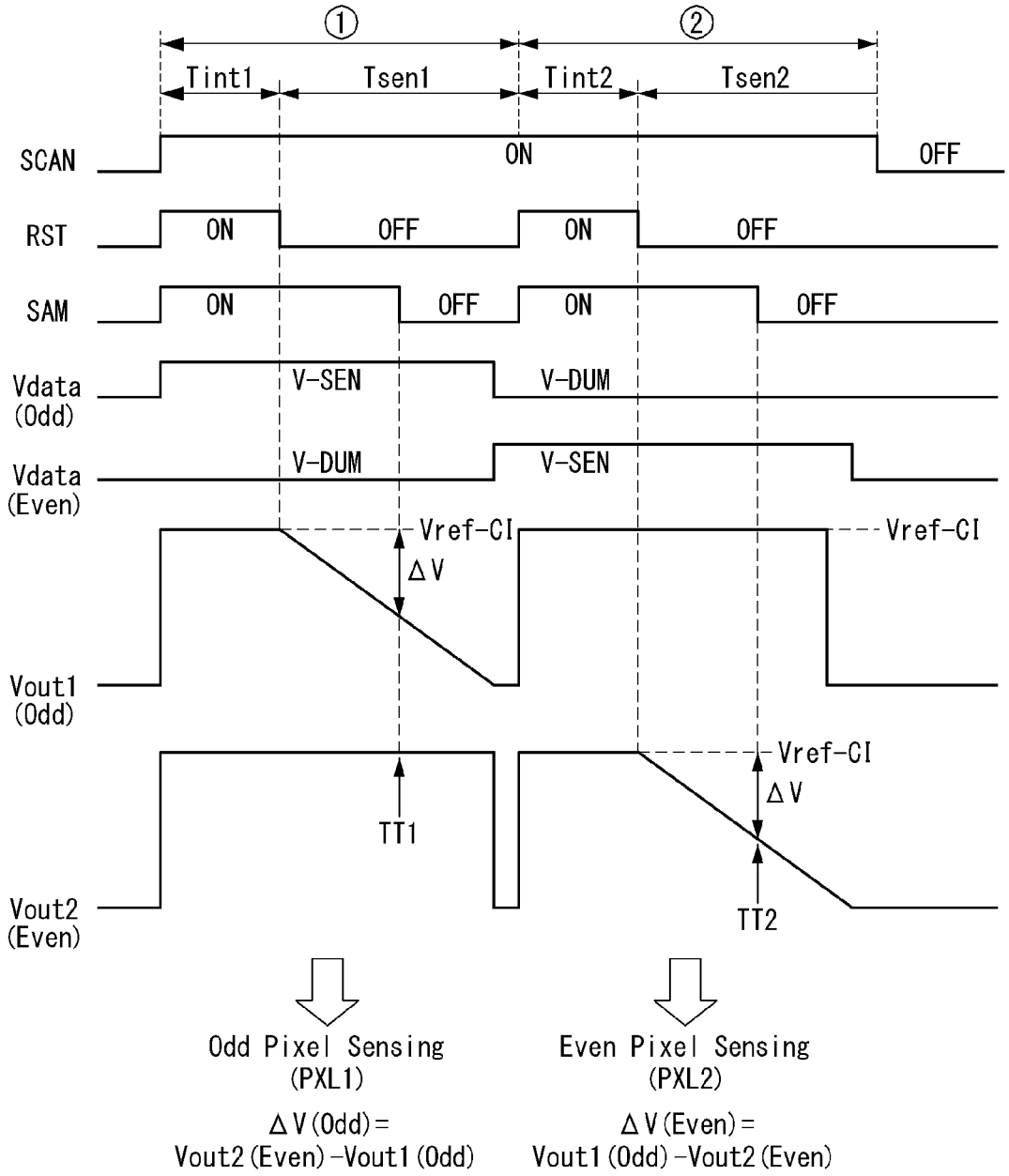

FIGS. 9 and 10 illustrate a pixel sensing method based on a correlated double sampling in the OLED display device according to an embodiment of the present disclosure.

Referring to FIGS. 9 and 10, the sensing unit 22 of the organic light emitting display device of the present disclosure comprises a first current integrator CI1 connected to a first pixel PXL1 through a first sensing line 150 and an odd-numbered sensing channel SCH1, a second current integrator CI2 connected to a second pixel PXL2 through a second sensing line 150 and an even-numbered sensing channel SCH2, and a sample and hold unit SH which correlated-double-sampling a first integral output voltage Vout1 which is a sensing result of the first current integrator CH and a second integral output voltage Vout2 which is a sensing result of the second current integrator CI2.

The sensing unit 22 respectively senses the first and second pixels PXL1 and PXL2 two times, in order to realize a first sensing process for removing the common noise component from the first integral output voltage Vout1 and a second sensing process for removing the common noise component from the second integral output voltage Vout2.

The first sensing process includes a first programming period Tint1 and a first sensing period Tsen1.

In the first programming period Tint1, a gate-source voltage of the first pixel PXL1 is set as a difference of the data voltage for sensing V-SEN and the integral reference voltage Vref-CI, and a gate-source voltage of the second pixel PXL2 is set as a difference of the dummy data voltage V-DUM and the integral reference voltage Vref-CI, In the first programming period Tint1, the driving TFT DT of the first pixel PXL1 is turned on by the gate-source voltage higher than a threshold voltage, and the driving TFT DT of the second pixel PXL2 is turned off by the gate-source voltage lower than a threshold voltage.

In the first sensing period Tsen1, a first pixel current Isen1 corresponding to the data voltage V-SEN for sensing flows through the driving TFT DT of the first pixel PXL1 and a common noise current Idum corresponding to the dummy data voltage V-DUM flows through the driving TFT DT of the second pixel PXL2.

In the first sensing period Tsen1, the first current integrator CH senses the first pixel current Isen1 flowing in the first pixel PXL1 through the first sensing line 150, and the second current integrator CI2 senses the common noise current Idum flowing in the second pixel PXL2 through the second sensing line 150.

In the first sensing period Tsen1, the sample and hold unit SH eliminates the common noise current Idum included in the first pixel current Isen1 based on the sensing output Vout1 of the first pixel current Isen1 which is the output of the first current integrator CH and the sensing output Vout2 of the common noise current Idum which is the output of the second current integrator CI2.

The second sensing process includes a second programming period Tint2 and a second sensing period Tsen2.

In the second programming period Tint2, a gate-source voltage of the first pixel PXL1 is set as a difference of the dummy data voltage V-DUM and the integral reference voltage Vref-CI, and a gate-source voltage of the second pixel PXL2 is set as a difference of the data voltage for sensing V-SEN and the integral reference voltage Vref-CI. In the second programming period Tint2, the driving TFT DT of the second pixel PXL2 is turned on by the gate-source voltage higher than a threshold voltage, and the driving TFT DT of the first pixel PXL1 is turned off by the gate-source voltage lower than a threshold voltage.

In the second programming period Tint2, the common noise current Idum corresponding to the dummy data voltage V-DUM flows through the driving TFT DT of the first pixel PXL1 and the second pixel current Isen2 corresponding to the data voltage V-SEN for sensing flows through the driving TFT DT of the second pixel PXL2.

In the second sensing period Tsen2, the first current integrator CH senses the common noise current Idum flowing in the first pixel PXL1 through the first sensing line 150, and the second current integrator CI2 senses the second pixel current Isen2 flowing in the second pixel PXL2 through the second sensing line 150.

In the second sensing period Tsen2, the sample and hold unit SH eliminates the common noise current Idum included in the second pixel current Isen2 based on the sensing output Vout1 of the common noise current Idum which is the output of the first current integrator CH and the sensing output Vout2 of the second pixel current Isen2 which is the output of the second current integrator CI2.

Figure 11:
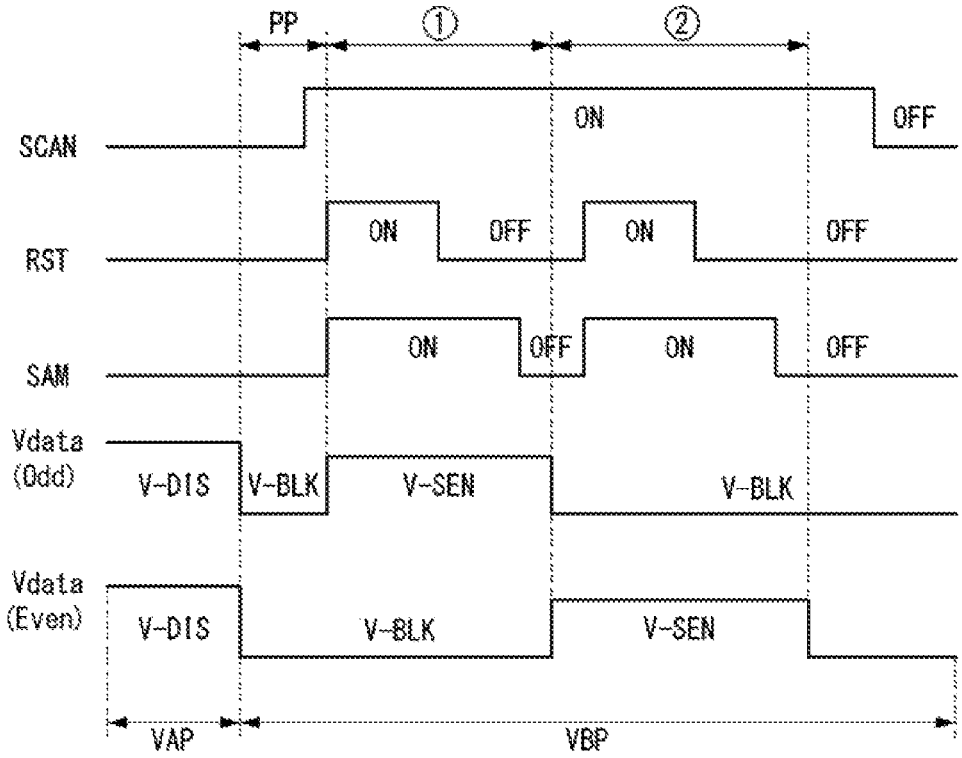
FIG. 11 illustrates that data voltage for black grayscale is applied to a corresponding pixel in order to sense a common noise current, as a comparative example of the present disclosure.
Figure 12:
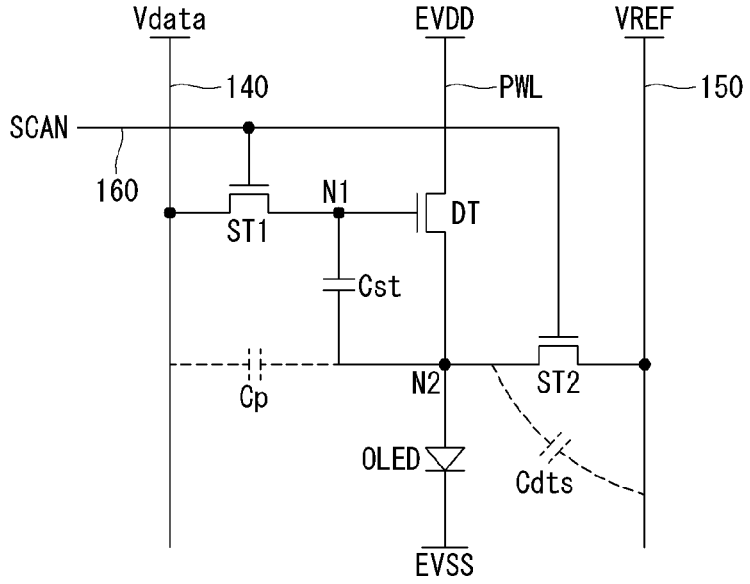
FIG. 12 is a diagram for explaining the reason that a sensing error increases in the comparative example of FIG. 11.

FIG. 11 illustrates that a data voltage for black grayscale is applied to a corresponding pixel in order to sense a common noise current, as a comparative example of the present disclosure, and FIG. 12 is a diagram for explaining the reason that a sensing error increases in the comparative example of FIG. 11.

Referring to FIG. 11, the first and second sensing processes ① and ② operate in the vertical blank period VBP. A transient period PP may further be positioned before the first sensing process ① in the vertical blank period VBP.

As shown in the comparative example of FIG. 11, the driving voltage generator 23 supplies the data voltage V-DIS for displaying during the vertical active period VAP to the data line 140. And, by supplying a data voltage V-BLK for black grayscale to the data line 140 before the gate signal SCAN is turned on in the transient period PP, the driving voltage generator 23 may initialize the voltage of the data line 140 which was charged to the data voltage V-DIS for displaying during the vertical active period VAP. Then, the driving voltage generator 23 performs the sensing processes by supplying the data voltage V-SEN for sensing and the data voltage V-BLK for the black grayscale to the data line 140. Here, the data voltage V-BLK for the black grayscale is a voltage capable of turning off the driving TFT DT, and has a large voltage difference with respect to the data voltage V-SEN for sensing as well as the data voltage V-DIS for displaying.

In each pixel PXL, there is a parasitic capacitor according to a manufacturing process. As an example of the parasitic capacitors, there are a first parasitic capacitor Cp which exists between the data line 140 and the source electrode of the driving TFT DT, a second parasitic capacitor Cdts which exists between the reference voltage line 150 and the source electrode of the driving TFT DT, and the like in FIG. 12.

If a voltage variation of the data line 140 is large, the source electrode voltage of the driving TFT DT may be distorted due to the coupling action of the parasitic capacitor Cp, resulting in a sensing error. The sensing error cannot be removed by the correlated double sampling method.

Figure 13:
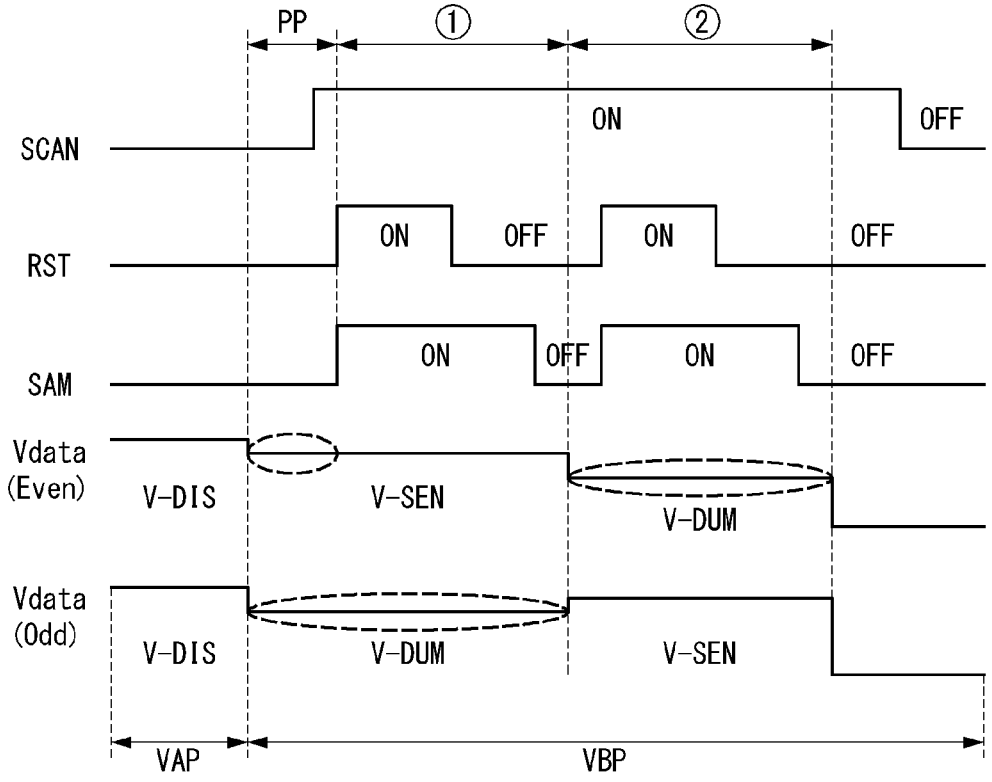
FIGS. 13 and 14 illustrate that a dummy data voltage higher than a voltage for black gradation data to a corresponding pixel in order to sense a common noise current, according to an embodiment of the present disclosure.
Figure 14:
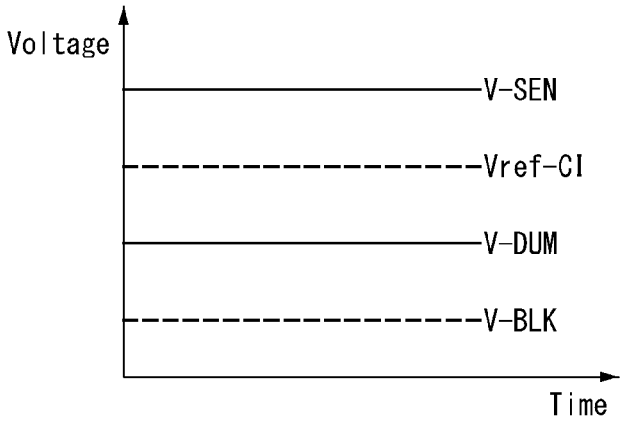

FIGS. 13 and 14 illustrate that a dummy data voltage higher than a voltage for black gradation data is applied to a corresponding pixel in order to sense a common noise current, according to an embodiment of the present disclosure.

Referring to FIG. 13, an embodiment of the present disclosure does not apply the data voltage V-BLK for the black grayscale to a corresponding pixel in order to sense the common noise current, but applies the dummy data voltage V-DUM higher than the data voltage V-BLK for the black grayscale. And, the embodiment maintains the voltage of the data line 140 at a constant level in the transient period PP and the first sensing process ①.

In other words, the driving voltage generator 23 supplies the data voltage V-DIS for displaying to the first data line 140 connected to the first pixel PXL1 and the second data line 140 connected to the second pixel PXL in FIG. 9 during the vertical active period VAP. During the transient period PP and the first sensing process ①, the driving voltage generator 23 supplies the data voltage V-SEN for sensing to the first data line 140 and also supplies the dummy data voltage V-DUM to the second data line 140. And, during the second sensing process ②, the driving voltage generator 23 supplies the dummy data voltage V-DUM to the first data line 140 and also supplies the data voltage V-SEN for sensing to the second data line 140. By doing so, the distortion of the source electrode voltage of the driving TFT DT due to the parasitic capacitor may be reduced.

The dummy data voltage V-DUM is higher than the data voltage V-BLK for the black grayscale and lower than the integral reference voltage Vref-CI as shown in FIG. 14. If using the dummy data voltage V-DUM higher than the data voltage V-BLK for the black grayscale and supplying the data voltage V-SEN for sensing or the dummy data voltage V-DUM to the data line 140 before the gate signal SCAN is turned on in the transient period, the voltage variation of the data line 140 and the coupling effect of the parasitic capacitor are reduced, so the source node voltage of the driving TFT DT may be stabilized within a short period of time.

The dummy data voltage V-DUM is for turning off the driving TFT DT, so must be lower than the integral reference voltage Vref-CI applied to the source electrode of the driving TFT DT in the programming period. The data voltage V-SEN for sensing is for turning on the driving TFT DT, so must be higher than the integral reference voltage Vref-CI applied to the source electrode of the driving TFT DT in the programming period.

As described above, by applying the correlated double sampling method, the common noise current of the panel reflected on each pixel current is removed, thereby improving the accuracy and reliability of sensing and compensation.

Furthermore, when applying the correlated double sampling method, the dummy data voltage higher than the data voltage for black grayscale is used instead of conventionally using the data voltage for the black grayscale. And, the time when the data voltage for sensing or the dummy data voltage is applied within the vertical blank period in which the sense driving is performed is advanced to the transient period.

By doing so, the voltage variation of the data line and the coupling effect of the parasitic capacitor are reduced and the source node voltage of the driving element is stabilized within a short period of time, so the sensing error due to the coupling effect of the parasitic capacitor may be suppressed as much as possible.

Throughout the description, it should be understood by those skilled in the art that various changes and modifications are possible without departing from the technical principles of the present disclosure. Therefore, the technical scope of the present disclosure is not limited to the detailed descriptions in this specification but should be defined by the scope of the appended claims.

What is claimed is:

1. A display device comprising:

a display panel having a first pixel and a second pixel;

a driving circuit coupled to the display device, the driving circuit for providing a preset sensing voltage to the first pixel of a display panel and providing a dummy voltage to the second pixel of the display panel;

a sensing circuit coupled to the display panel, the sensing circuit for sensing a current generated by the first and second pixels of the display panel, the sensing circuit comprising:

a first channel coupled to the first pixel, the first channel generating a first integrated voltage signal indicative of a magnitude of a first pixel current generated by the first pixel in response to the sensing voltage, and a second channel coupled to the second pixel, the second channel generating a second integrated voltage signal indicative of a magnitude of a first dummy current generated by the second pixel in response to the dummy voltage; and a compensation circuit coupled to the display panel, the compensation circuit determining a first compensation amount from a difference between an output of the first and second channels of the sensing circuit, and compensating a display voltage of the first pixel by the determined first compensation amount in a subsequent display frame of the display device, wherein the dummy voltage is higher than a data voltage of a black grayscale and lower than a reference voltage, wherein the data voltage of the black grayscale is capable of turning the first and second pixels off, and wherein the reference voltage is applied to a first amplifier included in the first channel and applied to a second amplifier included in the second channel.

2. The display device of claim 1, wherein the first channel comprises:

the first amplifier having a first input terminal receiving the reference voltage and a second input terminal coupled to the first pixel for receiving the first pixel current;

a first feedback capacitor coupled between the second input terminal of the first amplifier and an output of the first amplifier; and a first reset switch coupled between the second input terminal of the first amplifier and the output of the first amplifier in parallel with the first feedback capacitor; and wherein the second channel comprises:

the second amplifier having a first input terminal receiving the reference voltage and a second input terminal coupled to the second pixel for receiving the first dummy current;

a second feedback capacitor coupled between the second input terminal of the second amplifier and an output of the second amplifier; and a second reset switch coupled between the second input terminal of the second amplifier and the output of the second amplifier in parallel with the second feedback capacitor.

3. The display device of claim 2, wherein the first reset switch is closed to initialize the output of the first amplifier to be the reference voltage, and is opened after the output of the first amplifier has been initialized, and wherein the second reset switch is closed to initialize the output of the second amplifier to be the reference voltage, and is opened after the output of the second amplifier has been initialized.

4. The display device of claim 1, wherein the sensing voltage is greater than the reference voltage.

5. The display device of claim 1, wherein:

the driving circuit is further configured to provide the dummy voltage to the first pixel and provide the sensing voltage to the second pixel;

the first channel is further configured to generate a third integrated voltage signal indicative of a magnitude of a second dummy current generated by the first pixel in response to the dummy voltage;

the second channel is further configured to generate a fourth integrated voltage signal indicative of a magnitude of a second pixel current generated by the second pixel in response to the sensing voltage; and the compensation circuit is further configured to determine a second compensation amount from a difference between an output of the first and second channels of the sensing circuit, and compensating a display voltage of the second pixel by the determined second compensation amount in subsequent display frames of the display device.

6. The display device of claim 5, wherein the first compensation amount for the first pixel and the second compensation amount for the second pixel are determined during a first sensing period and a second sensing period, respectively.

7. The display device of claim 6, wherein one frame period comprises a vertical active period in which a data voltage for displaying is applied to the first and second pixels, and a vertical blank period including the first and second sensing periods, wherein the vertical blank period further comprises a transient period between the vertical active period and the first sensing period, and wherein the driving circuit is configured to:

supply the data voltage for displaying to the first and second pixels during the vertical active period, supply the sensing voltage to the first pixel and the dummy voltage to the second pixel during the transient period and the first sensing period, and supply the dummy voltage to the first pixel and the sensing voltage to the second pixel during the second sensing period.

8. The display device of claim 7, wherein the sensing circuit further comprises a sample and hold circuit performing a correlated-double-sampling of the first integrated voltage and the second integrated voltage during the first sensing period, and a correlated-double-sampling of the third integrated voltage and the fourth integrated voltage during the second sensing period.

9. The display device of claim 8, wherein the sample and hold circuit is configured to:

remove a common noise current included in the first pixel current based on the first integrated voltage and the second integrated voltage during the first sensing period, and remove the common noise current included in the second pixel current based on the third integrated voltage and the fourth integrated voltage during the second sensing period.

10. The display device of claim 8, wherein the first compensation amount for the first pixel and the second compensation amount for the second pixel are determined during the vertical blank period.

11. A method for sensing pixels of display device comprising:

providing a preset sensing voltage to a first pixel of the display device;

providing a dummy voltage to a second pixel of the display device;

receiving a first pixel current in a first channel from the first pixel, the first pixel current based on the provided sensing voltage;

receiving a first dummy current in a second channel from the second pixel based on the provided dummy voltage;

generating a first integrated voltage signal indicative of a magnitude of the first pixel current in the first channel;

generating a second integrated voltage signal indicative of a magnitude of the first dummy current in the second channel;

determining a difference between the first integrated voltage signal and the second integrated voltage signal;

determining a first compensation amount from the determined difference; and compensating a display voltage of the first pixel by the determined first compensation amount in a subsequent display frame of the display device, wherein the dummy voltage is higher than a data voltage of a black grayscale and lower than a reference voltage, wherein the data voltage of the black grayscale is capable of turning the first and second pixels off, and wherein the reference voltage is applied to a first amplifier included in the first channel and applied to a second amplifier included in the second channel.

12. The method of claim 11, wherein generating the first integrated voltage comprises:

initializing an output of the first amplifier to have the reference voltage; and integrating the received first pixel current to modify the output of the first amplifier with a rate according to a magnitude of the first pixel current.

13. The method of claim 11, wherein the sensing voltage is greater than the reference voltage.

14. The method of claim 11, further comprising:

providing the dummy voltage to the first pixel of the display device;

providing the sensing voltage to the second pixel of the display device;

receiving a second dummy current from the first pixel based on the provided dummy voltage;

receiving a second pixel current form the second pixel based on the provided sensing voltage;

generating a third integrated voltage signal indicative of a magnitude of the second dummy current;

generating a fourth integrated voltage signal indicative of a magnitude of the second pixel current;

determining a difference between the third integrated voltage signal and the fourth integrated voltage signal;

determining a second compensation amount from the determined difference between the third integrated voltage signal and the fourth integrated voltage signal; and compensating a display voltage of the second pixel by the determined second compensation amount in a subsequent display frame of the display device.

15. The method of claim 14, wherein the first compensation amount for the first pixel and the second compensation amount for the second pixel are determined during a first sensing period and a second sensing period, respectively.

16. The method of claim 15, wherein one frame period comprises a vertical active period in which a data voltage for displaying is applied to the first and second pixels, and a vertical blank period including the first and second sensing periods, and wherein the vertical blank period further comprises a transient period between the vertical active period and the first sensing period, wherein the sensing voltage is provided to the first pixel and the dummy voltage is provided to the second pixel during the transient period and the first sensing period, and wherein the dummy voltage is provided to the first pixel and the sensing voltage is provided to the second pixel during the second sensing period.

17. The method of claim 16, wherein determining a difference between the first integrated voltage signal and the second integrated voltage signal comprises performing a correlated-double-sampling of the first integrated voltage and the second integrated voltage during the first sensing period, and wherein determining a second compensation amount from the determined difference between the third integrated voltage signal and the fourth integrated voltage signal comprises performing a correlated-double-sampling of the third integrated voltage and the fourth integrated voltage during the second sensing period.

18. The method of claim 16, wherein the compensation amount for the first pixel and the second compensation amount for the second pixel are determined during the vertical blank period.

* * * * *